US007900795B1

(12) United States Patent
Cantolino

(10) Patent No.: US 7,900,795 B1
(45) Date of Patent: Mar. 8, 2011

(54) PAN WITH INTEGRATED SUPPORT SYSTEM AND FLOAT SWITCH/DRAIN MOUNT

(76) Inventor: Christopher Ralph Cantolino, Bradenton, FL (US)

( * ) Notice: Subject to any disclaimer, the term of this patent is extended or adjusted under 35 U.S.C. 154(b) by 864 days.

(21) Appl. No.: 11/786,667

(22) Filed: Apr. 12, 2007

(51) Int. Cl.
*B65D 1/34* (2006.01)

(52) U.S. Cl. ..... 220/608; 220/571

(58) Field of Classification Search ..... 220/571, 220/571.1, 572, 573, DIG. 6, 608
See application file for complete search history.

(56) References Cited

U.S. PATENT DOCUMENTS 2,542,338 A * 2/1951 Laufenberg ..... 4/251.2
2,951,674 A * 9/1960 Rice ..... 267/141.4
3,485,434 A * 12/1969 Donovan et al. ..... 229/406
4,025,063 A * 5/1977 Willison ..... 267/153
4,656,067 A * 4/1987 Yetter ..... 206/557
7,637,387 B1 * 12/2009 Cantolino ..... 220/571
7,673,646 B1 * 3/2010 Cantolino ..... 137/15.01
2008/0000250 A1 * 1/2008 Cantolino ..... 62/285

* cited by examiner

*Primary Examiner* — Stephen Castellano
(74) *Attorney, Agent, or Firm* — Dorothy S. Morse

(57) ABSTRACT

A rugged pan for supporting a fluid-producing unit in fluid collection and overflow applications. The pan has an integrated support system for enhanced material strength, which reduces cracking and premature failure during installation and extended periods of use. Strengthening features include perimeter grommets, angled corners, at least three elongated and longitudinally-extending center supports each having a non-linear perimeter configuration, a corrugated array of laterally-extending uppercuts and undercuts substantially across the pan, and a stress-transferring member connected between adjacent non-linear supports. The pan also has damper inserts secured on top of its non-linear supports and a perimeter quick-mounting shelf area for mating with a drain line connection having fixed relation to a float switch that achieves float body leveling when the pan is placed into a level orientation, to provide reliable float body deployment that shuts off the fluid-producing unit when collected fluid in the pan exceeds a pre-determined safe amount.

20 Claims, 6 Drawing Sheets

PAN WITH INTEGRATED SUPPORT SYSTEM AND FLOAT SWITCH/DRAIN MOUNT

CROSS-REFERENCES TO RELATED APPLICATIONS

None.

BACKGROUND

1. Field of the Invention

This invention relates to condensate pans and liquid-level-activated float switches, specifically to a fluid-collecting tray or pan with an integrated support system configured to provide it with enhanced material strength and improved safety during its use, particularly when the pan is used to support of a heavy fluid-producing unit while suspended via lumber, struts, and/or other laterally-extending under-pan supports and cable from an overhead location. The structured design and materials used for manufacture of the present invention pan allows it to resist cracking and premature failure during installation, as well as failure during its use in various fluid collection and overflow prevention applications. When mentioned hereinafter, the terms "tray" and "pan" are to be considered interchangeable, unless specifically noted otherwise. The primary use contemplated for the present invention pan is support and overflow prevention for a fluid-producing unit, wherein if the usual discharge pathway for produced fluid becomes blocked and causes fluid to accumulate in the pan and rise above a pre-determined level considered safe, a float switch associated with the pan will deploy and promptly shut-off the unit's operation to prevent damage to the unit and/or its surroundings. An equally important use of the present invention pan is management of the routine cycles of fluid accumulation and evaporation expected during the support of a system or unit that at least periodically produces condensate as a by-product of its operation, perhaps as a result of inadequate insulation. Spaced-apart uppercuts incorporated throughout the inside bottom surface of the pan collectively provide balanced weight distribution of accumulated fluid, since the uppercuts each have the capability of isolating a small amount of fluid separately from that collected in other parts of the pan, instead of allowing accumulated fluid to run together and pool in a single area of the pan, which could lead to bowing and/or buckling in that area and a potential for pan collapse, particularly if the pan is supporting a heavy object in an elevated position, such as support of the air handler of an air conditioning system in an out-of-the-way position near the ceiling of a garage. Further, by capturing routinely accumulating fluid in this manner, excess fluid is not directed to the float switch to cause premature unit shut-off or pooling of fluid around the float body that could transport debris to the float body, and/or promote algae growth on it, both of which could seriously interfere with proper, reliable, and repeat float body deployment when needed for emergency shut off of the fluid-producing unit to prevent overflow or damage.

In many common applications, such as the elevated support of an air handler in a portion of a residential building, such as a garage, the integrated support system of the present invention pan will typically include three supports each having a non-linear perimeter configuration that is shaped to reduce the number of pressure points that could lead to cracking of the pan material during installation and extended periods of use. Thus, in ensuing discussions herein, reference will often be made to a center support and two non-linear supports, which relate back to this most preferred embodiment of the present invention contemplated for residential use. However, more than three longitudinally-extending supports are contemplated for other applications as long as each support used had a non-linear or arcuate perimeter that reduces the formation of pressure points and is otherwise configured and positioned between the perimeter grommets to provide sturdy and balanced support of a fluid-producing unit with minimal stress line presence at the interface of the supports and the bottom surface of the pan. The non-linear perimeter of the present invention center support and its widened convex lower central portion, in combination with the two lateral supports typically positioned on opposite sides of the center support that also have non-linear perimeters and a non-linear longitudinal axis, allow the weight of a heavy fluid-producing unit positioned on the supports to be distributed across a large portion of the pan's bottom surface, thereby reducing the presence of stress lines that could lead to premature cracking of pan material and its failure. Also, the high-friction damper inserts associated with the top surface of each of the three supports collectively provide an important safety-enhancing structural feature of the present invention pan by reducing the potential for sliding movement of the supported fluid-producing unit relative to the pan that could otherwise create a weight imbalance, float switch malfunction, and/or enhanced likelihood of pan collapse. Typically, one damper insert is secured into each recess on the top surfaces of the center support and lateral non-linear supports. However, several damper inserts in a vertically stacked array may also be used to adjust the fluid-producing unit to an optimum working height. In addition to maintaining the fluid-producing system in its intended position of use upon the present invention pan, thereby avoiding unexpected weight transfer that could lead to pan collapse, the damper inserts may also be relied upon to reduce vibration and provide enhanced heat deflection around the supported fluid-producing unit.

Further, integrated pan structure also includes the previously mentioned uppercuts that provide balanced fluid capture within the inside bottom surface of the pan and one stress-transferring member located between adjacent non-linear supports, wherein the transfer of stress between the longitudinally-extending supports reduces the likelihood of the pan warping and buckling under load. It is preferred for only one stress-transferring member to be positioned on each side of the center support so as not to entrap large quantities of fluid centrally within the pan to avoid bowing and distortion, with the stress-transferring members also providing the benefit of lowered manufacturing cost since they allow thinner pan materials to be used without a reduction in weight load capability. In addition, the staggered interior-projecting edges of perimeter grommets and angled corners, in combination with the primarily polycarbonate material used for construction of the present invention pan, significantly help to reduce stress points and the potential for pan cracking as a result of handling during installation, a common problem experienced with prior art pans. Another important safety-related structural feature of the present invention is the presence of multiple laterally-extending undercuts incorporated into the outside bottom surface of the present invention pan. They are each configured to receive a 2"×4" piece of lumber, strut, or other under-pan support contemplated for use under the bottom surface of the present invention pan to support it in an elevated and suspended position via cable connected to an overhead location, with the installer selecting the number and positioning of undercuts best used for balanced support of the pan in each application. With the under-pan supports each laterally isolated and fixed in position via the undercuts, weight shifts due to fluid accumulation in the pan, vibration, and/or other factors cannot easily cause the under-pan supports to slip sideways relative to the pan whereby the pan and the heavy fluid-producing unit it supports could eventually become unbalanced and placed at risk for falling, where an automobile or people moving around a motor vehicle under the pan could become injured. Additionally, present invention pan structure also includes a quick-mounting shelf area for rapid attachment of a drain line connection having a complementary configuration and a fluid-level-activated float switch in fixed association therewith. Attachment of the drain line connection to the shelf automatically places the float switch in a leveled orientation relative to the pan. Thus, when the pan is prepared for support of a fluid-producing unit and placed into a level orientation during its installation, the deployable float body within the float switch attached to the pan instantly and without other adjustment becomes poised for proper, reliable, and repeat deployment to shut off the fluid-producing unit supported by the pan when excess fluid from the unit collects in the pan beyond a pre-determined threshold amount considered safe. The shelf contains a drain line opening and is also positioned adjacent to a recessed area formed from multiple horizontally-extending and vertically-stacked arcuate ribs that are configured to protect the float switch housing against side impact during installation and use. To support a heavy fluid-producing unit, the present invention requires rugged construction and the use of materials that are strong, impact resistant, impervious to corrosion, unaffected by extreme ambient temperature fluctuations, and resistant to buckling, bowing, warping, distortion, and collapse during extended use. Further, depending upon the intended application, it may also be preferred for the present invention pan to have UV-resistant capability. In addition, although not critical, it is preferred for at least some of the strengthening features of the present invention to have a nesting configuration for efficient stacking one upon the other for compact storage and transport.

2. Description of the Related Art

When air conditioning condensate and other condensates are collected, there is often a risk of overflow or back-up into the system producing it. As a result, liquid-level float switches have been employed with collection pans to shut-off the source of condensate flow when the amount of fluid collected in them exceeds a predetermined depth considered safe. The goal of the present invention is provide a tray or pan for the collection of condensates and other fluids wherein the pan is made from rugged materials and has a sturdy construction that facilitates installation, shortens installation time, provides stable installation, reduces the potential for cracking during installation particularly during elevated installations, reduces the possibility of pan collapse due to unbalanced weight distribution when fluid accumulated in the pan, minimizes maintenance after pan installation, and takes the guesswork out of selecting and mounting a float switch to provide immediate, reliable, and repeat electrical shut-off deployment of a fluid-level-activated float body when fluid accumulating in the pan exceeds a pre-established or custom-set threshold amount. Further, since air conditioning condensate collection pans are typically installed in hot attics, garages, and other places where temperatures can easily exceed 150 degrees Fahrenheit and where significant temperature fluctuations can also occur, and further since many prior art plastic condensate collection pans have insufficient construction whereby a float switch mounted on its upper edge will lean in over a period of time and no longer be maintained in the needed vertical orientation for a prompt and reliable response to excessive condensate collection in its associated pan, the present invention is also configured to overcome the lean in problem through integrated structural features that include perimeter grommets, a quick-mounting shelf area, and multiple horizontally-extending arcuate ridges in vertically-stacked array that are adjacent to the shelf area for float switch housing protection. In addition, the float switch assembly contemplated for use with the present invention pan is in fixed attachment to a drain line connection having a configuration complementary to that the pan's quick-mounting shelf area, which significantly reduces installation time and assures automatic leveling of the float body relative to the pan, so that when leveling of the pan occurs, the float switch is also leveled and remains in its original location and leveled orientation during the entire time period of use, and will not be subject to changes in orientation over time. Also, since the float body used with the present invention is not routinely in contact with accumulated fluid as a result of the segregated and balanced fluid collection provided by its spaced-apart uppercuts, there is a reduced likelihood of fluid pooling around the float body and it is less likely to become clogged with mold, algae, and/or debris, which could otherwise cause it to malfunction, resulting in continued and reliable float body operation during the entire time period anticipated for use. Another problem overcome by the present invention pan is the likelihood of pan failure resulting from cracking, bowing, distortion, bending, warping, buckling, and/or collapse due to fluid distribution imbalance, particularly when the pan is suspended in an elevated position. Extended stress lines are also avoided by many features integrated into the present invention pan, including the use of curved perimeter surfaces in the non-linear support members, the widened convex lower central portion of the center support, the staggered interior-projecting edges of the grommets, the angled corners, the corrugated configuration of uppercuts and undercuts, the undercuts being configured for secure and fixed receipt of under-pan supports, the perpendicular interfacing of the longitudinally-extending support members with the horizontally-extending uppercuts and undercuts, and the stress-transferring members between the non-linear support members. No other apparatus is known that functions in the same manner or provides all of the advantages of the present invention.

BRIEF SUMMARY OF THE INVENTION

It is the primary object of this invention to provide a tray or pan of rugged construction with an integrated support system configured to provide the enhanced material strength that allows it to resist cracking and premature failure during installation, as well as prevent failure or collapse during its use in fluid collection and overflow prevention applications. It is also an object of this invention to provide a pan with a quick-mounting shelf area for prompt installation of a liquid-level-activated float switch that is automatically leveled for proper, reliable, and repeat use when the pan is placed into a level orientation. A further object of this invention is to provide a pan with structural features that allow for safe suspended installation from an overhead location via under-pan supports and cable. It is also an object of this invention to provide a pan configured to periodically hold some fluid without emergency shut-off of the system producing it, with structural features configured to isolate small accumulations of fluid throughout its bottom surface for balanced fluid distribution during its containment therein that prevents collected fluid from pooling in one location, thus reducing the likelihood for pan distortion, shifts in pan position that would interfere with reliable float body deployment, and/or pan collapse. It is a further object of this invention to provide a pan made from materials that are strong, impact resistant, impervious to corrosion, unaffected by extreme ambient temperature fluctuations, and resistant to buckling, bowing, warping, distortion, and collapse during extended use. It is also an object of this invention to provide a pan that enhances reliable float switch operation by protecting its associated float body during long term use against clogging with mold, algae, and/or debris, including the loose insulation fibers typically encountered in attics with some air conditioning system applications.

The present invention, when properly made and used, will provide a pan for use in fluid collection and overflow prevention applications. It has an integrated support system configured to have enhanced material strength and safety improvements that are particularly useful when it is employed for elevated support of a heavy fluid-producing unit. The structured design of the present invention pan and the polycarbonate material from which it is substantially made, allows it to resist cracking during installation, as well as bowing, bending, warping, buckling, distortion, and collapse during extending periods of use. The primary use contemplated for the present invention pan is support and overflow prevention for a fluid-producing unit, wherein if the usual discharge pathway for produced fluid becomes blocked and causes fluid to accumulate in the pan and rise above a pre-determined level considered safe, a float switch associated with the pan will deploy and promptly shut-off the unit's operation to prevent damage to the unit and/or its surroundings. An equally important use of the present invention pan is management of the routine cycles of fluid accumulation and evaporation expected to occur in it during the support of a system or unit that at least periodically produces condensate as a by-product of its operation, perhaps as a result of inadequate insulation, with spaced-apart uppercuts incorporated into the structure of the pan providing for the needed balanced weight distribution as a result their collective capability to isolate small amounts of fluid throughout the bottom of the pan. Thus, instead of allowing collected fluid to run together and pool in a single area of the pan that could lead to bowing and/or buckling of that area and the potential for pan collapse, particularly if the pan is supporting a heavy object in an elevated position, such as support of the air handler of an air conditioning system in an out-of-the-way position near the ceiling of a garage, the uppercuts separate accumulated fluids and facilitate their evaporation. Balanced weight distribution for the heavy fluid-producing unit supported across a large portion of the pan's bottom surface is accomplished by the non-linear perimeters of an elongated center support at least two elongated supports laterally positioned to the center support, as well as the widened convex lower central portion of the center support. High-friction damper inserts associated with the top surface of each of the three supports also help to manage weight distribution by collectively reducing the potential for slipping movement of the supported fluid-producing unit relative to the pan. Multiple damper inserts in a vertically stacked array may be used to adjust the fluid-producing unit to an optimum working height. Damper inserts also can provide reduced vibration and enhanced heat deflection around an associated fluid-producing unit. Further, a single stress-transferring member located between adjacent supports also reduces the potential for pan buckling and/or collapse under load, and does so without entrapping fluid centrally in the pan which could occur if more than one such stress-transferring member were used. Also, manufacturing cost can be reduced by use of the stress-transferring members, since they strengthen pan structure and allow the same fluid-producing unit to be supported with less material thickness. In addition, the non-linear perimeters of all longitudinally-extending supports in the present invention pan, the staggered interior-projecting edges of its perimeter grommets, and its angled corners, in combination with the primarily polycarbonate material used for its construction, significantly reduce stress points and potential for pan cracking, a common problem experienced with prior art pans. An important safety-related structural feature of the present invention is the incorporation of multiple laterally-extending undercuts into the outside bottom surface of the present invention pan. They are each configured to capture and isolate a horizontally-extending 2"×4" piece of lumber, strut, or other elongated under-pan support used to place the present invention pan in an elevated and suspended position via one or more cables attached to an overhead location, with the installer selecting the number and location of undercuts best used in each application for balanced pan support under load. With each of the under-pan supports thus fixed in position by an undercut extending laterally under the pan, weight shifts due to fluid accumulation in the pan, vibration, and/or other factors cannot easily cause the under-pan supports to slip sideways relative to the pan, reducing the risk of the pan and the heavy fluid-producing unit it supports falling and injuring people and/or property positioned below. The quick-mounting shelf area of the present invention pan, which is used for attaching a drain line connection of complementary configuration that is in fixed association with a vertically deployable float switch, allows for rapid float switch installation, placement of the float switch into a level orientation relative to the pan, and automatic leveling of the float body when the pan is placed into a level orientation as a part of its installation. Only a simple height adjustment of the deployable float switch body during installation according to the quantities of fluid collection anticipated in an application, may additionally be required. Materials used for the present invention pan are strong, impact resistant, heat resistant, impervious to corrosion, non-flammable, unaffected by large ambient temperature fluctuations, and resistant to buckling, bowing, warping, distortion, and collapse during extended use. Further, depending upon the intended application, it may also be preferred for the present invention pan to have UV-resistant capability. Polycarbonate, polycarbonate alloys, and polycarbonate blends are preferred materials for the present invention pan, including but not limited to polycarbonate alloys and blends using ABS, PBT, PET, and PP.

The description herein provides preferred embodiments of the present invention but should not be construed as limiting its scope. For example, variations in the number, placement, height dimension, and configuration of high-friction damper inserts used; the material from which damper inserts are made and whether they would be readily replaceable; the number, width dimension, and depth dimension of the perimeter grommets used; whether all of the perimeter grommets have a uniform width dimension; the number, positioning, size, and configuration of undercuts integrated into the bottom surface of the pan; the height of the center non-linear supports above the perimeter grommets; and the configuration of the quick-mounting shelf area, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 3:
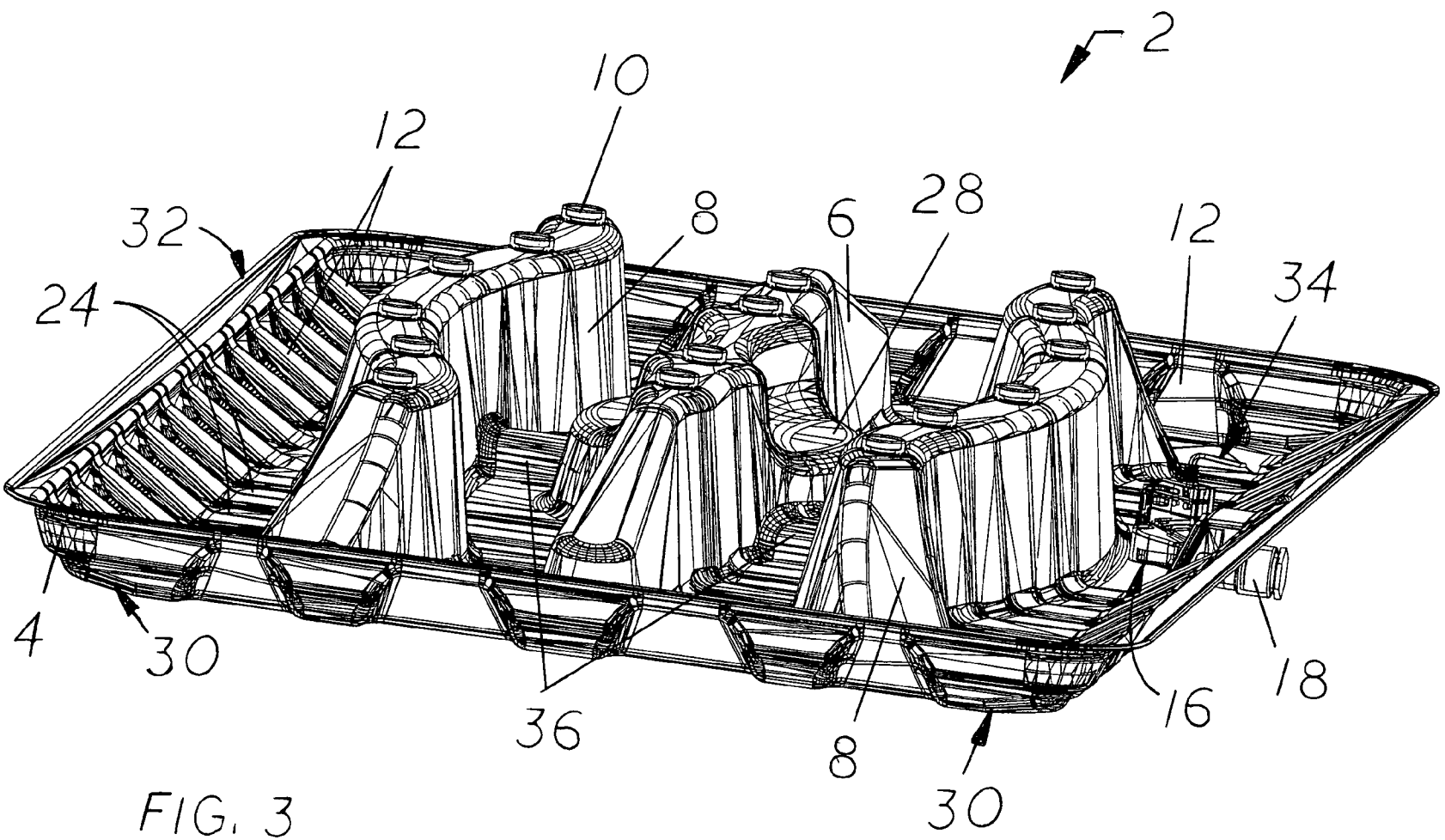
FIG. 3 is a perspective view of the most preferred embodiment of the present invention having a center support and two non-linear supports each having damper inserts associated with their top surfaces and extending substantially across the length of the pan, perimeter grommets integrated into the pan's walls, angled corners, uppercuts substantially across the width of the pan, a stress-transferring member connected between the center support and each non-linear support member with purposefully non-aligned positioning, and a float switch and drain line connection assembly secured to the pan where a drain opening is located.
Figure 4:
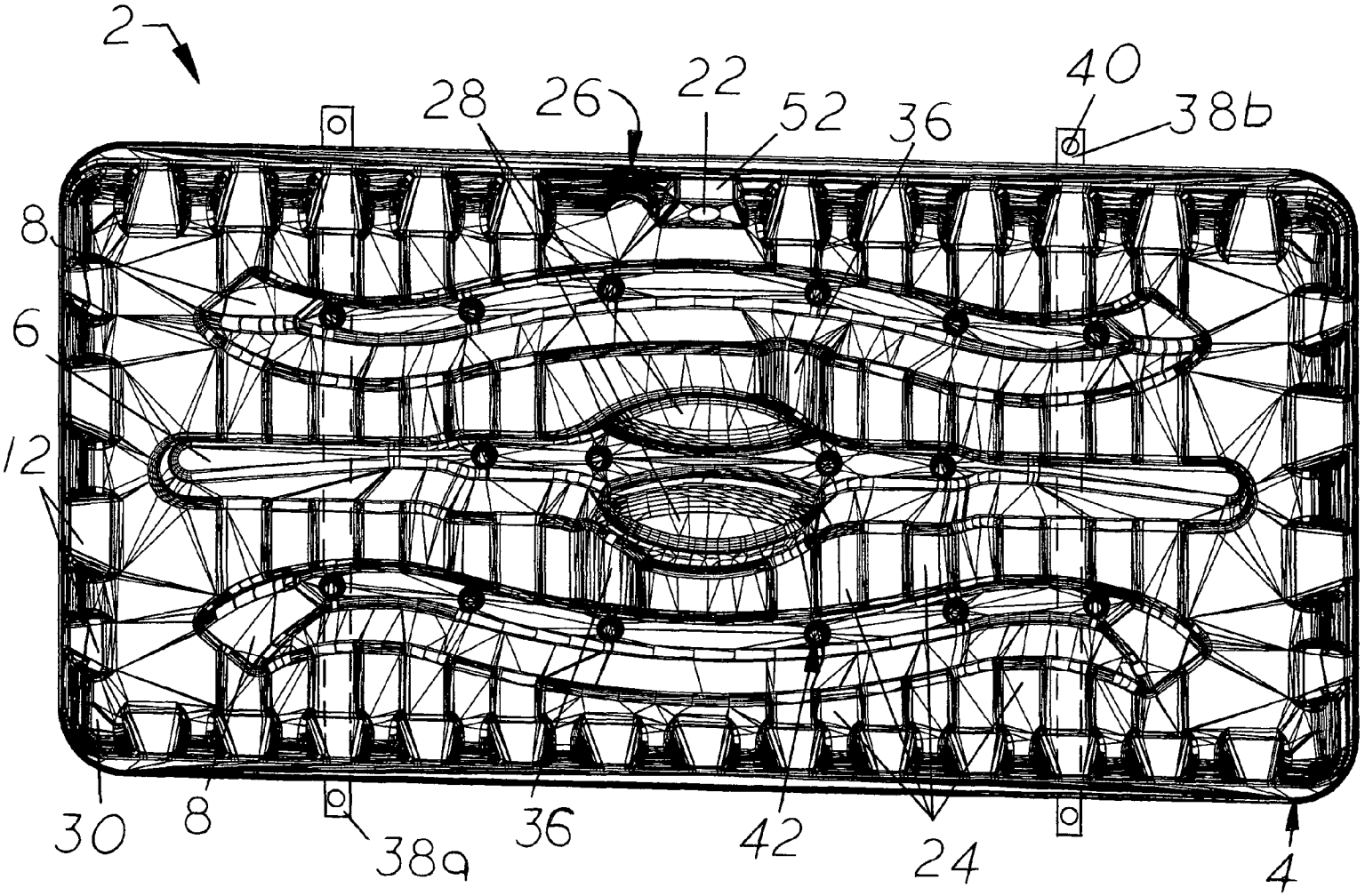
FIG. 4 is a top view of the most preferred embodiment of the present invention having a center support and two non-linear supports each having multiple recesses for damper insert engagement on their top surfaces, the supports each extending substantially across the length of the pan, the center support having a greater length dimension than the non-linear supports, grommets integrated into the perimeter wall, angled corners, spaced-apart uppercuts substantially across the pan's inside bottom surface, one stress-transferring member connected between the center support and each non-linear support, a float switch quick-mounting shelf area with a drain opening centrally on one side of the pan, and two struts extending laterally under the pan and aligned with different undercuts so as to provide balanced support of the pan when it is in suspended use.
Figure 5:
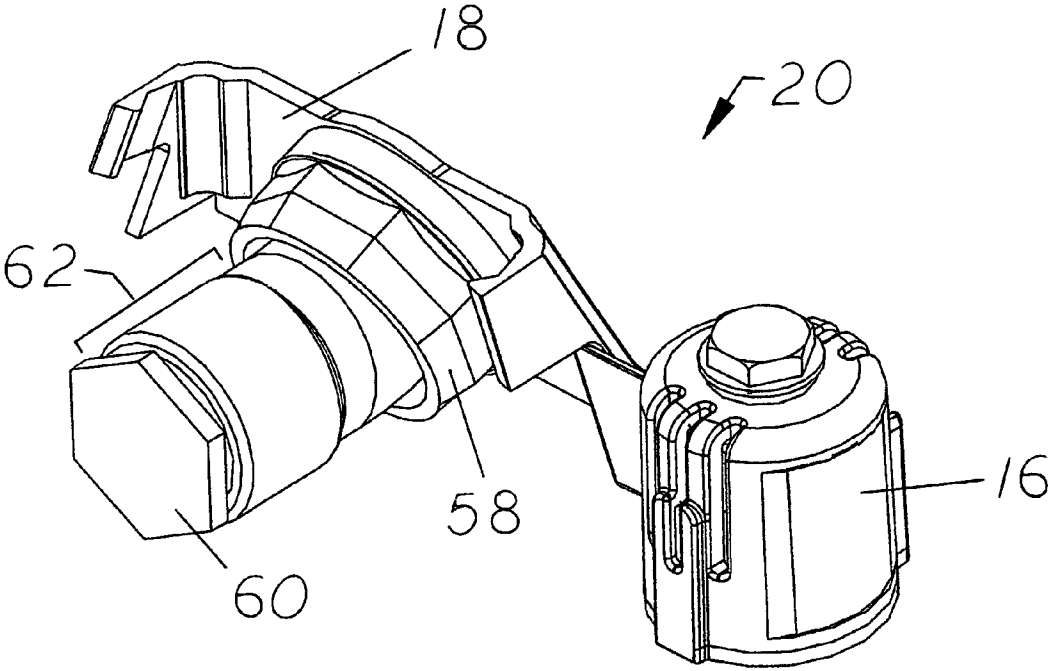
FIG. 5 is a back view of one preferred configuration of a float switch and drain line connection assembly that can be connected to the quick-mounting shelf area on the most preferred embodiment of the present invention with the drain line connection portion of the assembly having a configuration complementary to that of the quick-mounting shelf area.

While FIGS. 1-4 show the most preferred embodiment 2 of the present invention fluid collection pan 4, FIG. 5 shows a combined float switch and drain connection assembly 20 usable with the present invention quick-mounting shelf area 52 shown in FIG. 4, and FIGS. 6-9 show two of the preferred styles of damper inserts 10, domed cap 44 and ring 46, that can be used with support members 6 and 8 in the present invention pan 4 for vibration reduction, enhanced heat dissipation around an associated fluid-producing unit (not shown), and to prevent sliding movement of the fluid-producing unit away from its originally installed position. It is to be understood that many variations in the present invention are possible and also considered to be a part of the invention disclosed herein, even though such variations are not specifically mentioned or shown. As a result, a reader should determine the scope of the present invention by the appended claims.

FIGS. 1-4 show the most preferred embodiment 2 of the present invention fluid collection pan 4 having a center support 6 and two non-linear supports 8 each extending substantially across the length of pan 4. Residential use in a garage for elevated support of an air conditioning system air handler (not shown) is a common application contemplated for most preferred embodiment 2. Additional non-linear supports 8 may be used in pans 4 configured for other applications, as long as the supports 8 can be dimensioned and positioned to promote the same balanced fluid distribution and safety goals that are achieved with the configuration and positioning of the two non-linear supports 8 shown in FIGS. 1-4. The two non-linear supports 8 are purposefully curved to widen the portion of the bottom surface of pan 4 directly bearing the weight load of a fluid-producing unit (not shown) placed upon them and center support 6, to further reduce tendencies of pan 4 toward bending, bowing, warping, cracking, and/or other distortion that have been found to occur in prior art pans during the extended periods contemplated for use. Although the length, width, and height dimensions of pan 4 are not critical, they must be appropriate to the intended application and not so overly large in comparison to the fluid-producing unit intended for association with it, that material waste occurs. Also, the height dimensions of center support member 6 and non-linear support members 8 must all be similar to provide balanced support for an associated fluid-producing unit (not shown). Further, supports 6 and 8 generally are configured to substantially fill the interior bottom surface of pan 4, to reduce the weight of fluid that will be collected in the pan prior to unit shut-off by an associated float switch (such as the switch shown by the number 20 in FIG. 5). Support members 6 and 8 are also configured and positioned to leave spaced-apart uppercut areas 24 (see FIG. 4) across the inside bottom surface of pan 4 for use in balanced weight distribution of small amounts of fluid during anticipated routine cycles of accumulation and evaporation without pan 4 bowing, buckling, or otherwise experiencing distortion.

Figure 1:
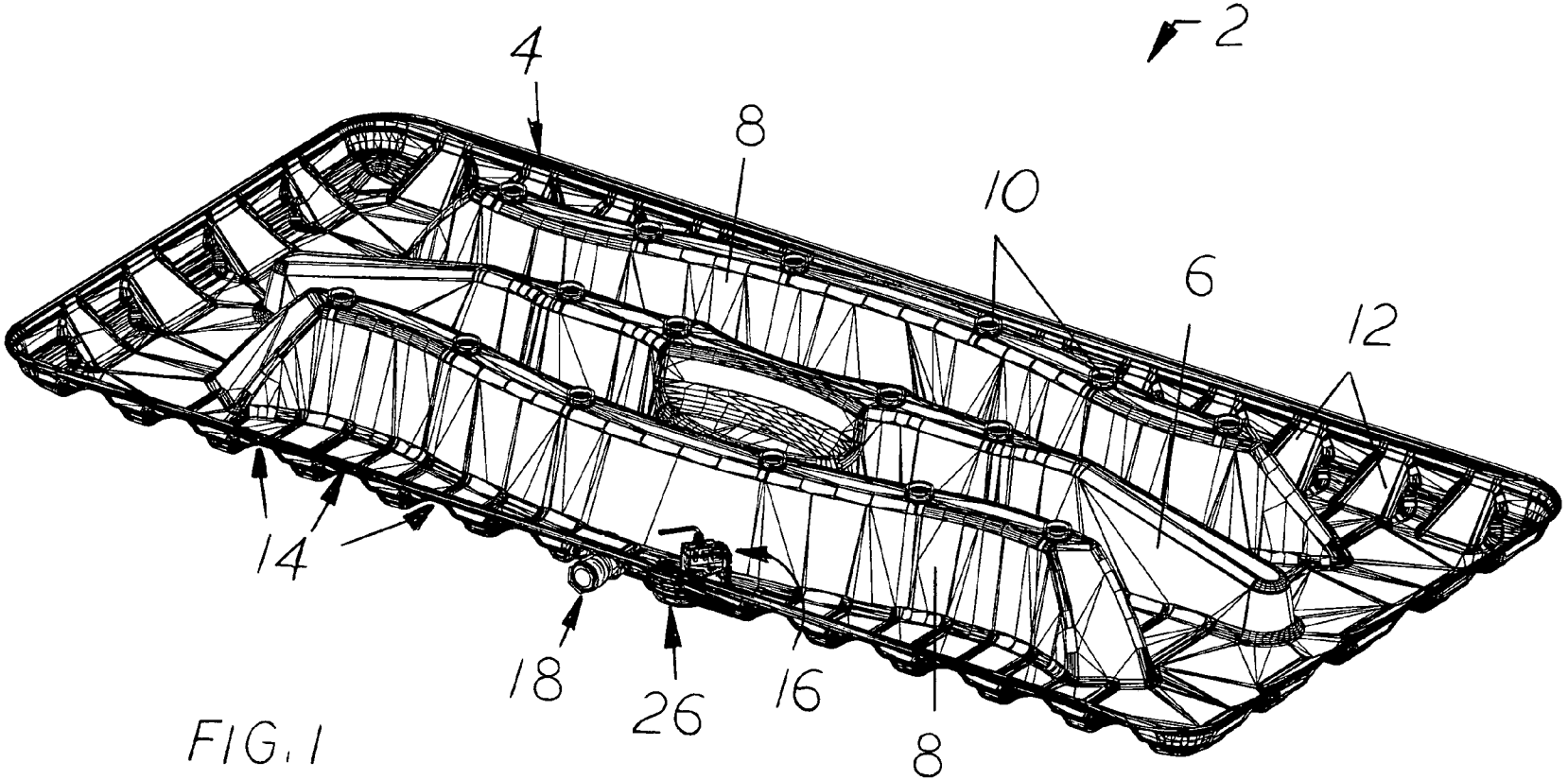
FIG. 1 is a perspective view of the most preferred embodiment of the present invention pan having a center support and two non-linear supports each with damper inserts on their top surfaces and extending substantially across the length of the pan, and the center support having a greater length dimension than the non-linear supports, with the pan also having grommets integrated into its perimeter wall, undercuts extending substantially across the width of the pan, and a float switch and drain line connection assembly connected to one side of the pan around a drain opening.

FIG. 1 is a perspective view of most preferred embodiment 2, and shows a substantially rectangular configuration for pan 4, which is preferred but not critical. FIG. 1 also shows multiple damper inserts 10 associated with the top surfaces of support members 6 and 8. Although FIG. 1 shows six damper inserts 10 attached to each non-linear support 8 and four damper inserts 10 attached to center support 6, the number of damper inserts 10 used is not critical, as long as sufficient to support the fluid-producing unit in a substantially fixed position and reduce vibrations and provide enhanced heat dissipation around the fluid producing unit where needed. Further, although it is contemplated for damper inserts 10 to be made from rubber or other high-friction material, it is also considered to be within the scope of the present invention for other materials to be used. Also, FIG. 1 shows the height dimensions of supports 6 and 8 being similar to one another, center support 6 having a slightly greater length dimension than non-linear supports 8, supports 6 and 8 extending substantially across the length of pan 4, perimeter grommets 12 integrated into the wall of pan 4, undercuts 14 extending substantially across pan 4, and a combined float switch 16 and drain line connection 18 assembly (identified independently by the number 20 in FIG. 5) connected centrally to one side of pan 4 where a drain opening (shown by the number 22 in FIG. 4) for fluid discharge from pan 4 is located. Also shown in FIG. 1 is the vertically-stacked and horizontally-extending array of arcuate ribs (designated by the number 26) that protects float switch 16 from side impact once the drain line connection 18 in fixed association with float switch 16 is securely attached to the complementary configuration of quick-mounting shelf area 52 (shown in FIG. 4). In contrast, FIG. 2 is an end view of the most preferred embodiment 2 of the present invention pan 4 which shows the center support 6 and two non-linear supports 8 being similar in height and each having damper inserts 10 associated with their top surfaces, angled corners 30 that reduce stress points and thereby strengthen the structure of pan 4, an upturned perimeter lip 32 providing additional strength and fluid collection capacity for pan 4, the electrical wiring 34 extending from the top of a float switch (hidden behind the wall of pan 4 in FIG. 2, but shown by the number 16 in FIG. 1) that is connected to the fluid-producing unit for emergency shut off purposes once float switch 16 is activated by rising fluid levels beyond pre-selected levels considered safe, and a part of the drain line connection 18 extending beyond the left side of pan 4 that can be connected to a drain pipe (not shown) for discharge of surplus fluid from pan 4.

Figure 2:
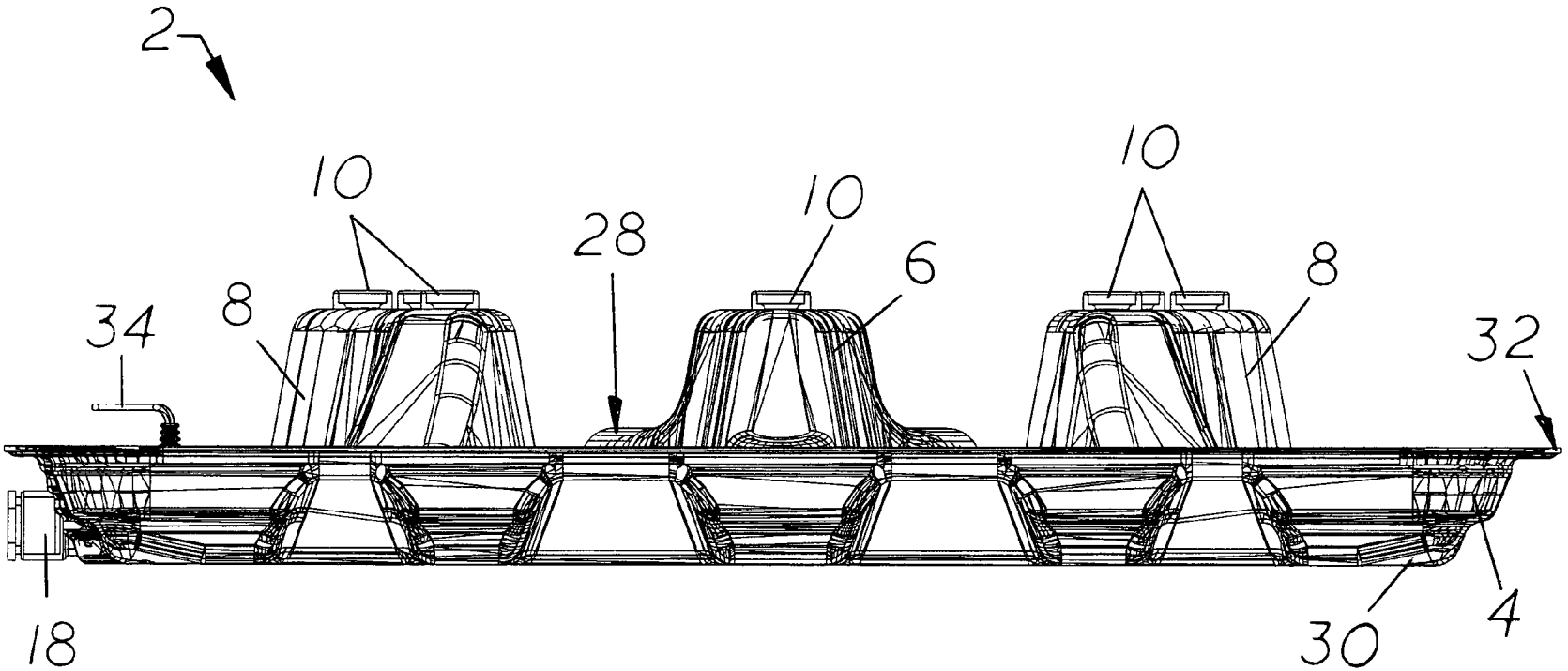
FIG. 2 is an end view of the most preferred embodiment of the present invention with the center support and two non-linear supports each having damper inserts on their top surfaces, angled corners, an upturned perimeter lip, the electrical wiring extending from the top of a float switch visible on the left of the illustration, and part of the drain line connection extending beyond the left side of the pan where a drain opening is located.

FIG. 3 is a perspective view of the most preferred embodiment 2 of the present invention pan 4 similar to the end view of FIG. 2, but raised to show more of the structure within pan 4. A reader should note that the raised perspective view shown in FIG. 3 may initially appear to contradict the length and width dimensions of pan 4 shown in FIGS. 1 and 4, as the end of pan 4 positioned closest to the reader in FIG. 3 is actually shorter in dimension than the left side of pan 4 extending rearwardly from it where grommets 12 and lip 32 are marked. Once the pan structure in FIG. 3 is more carefully compared to that in FIGS. 1 and 4, the forced perspective of the view in FIG. 3 becomes obvious. FIG. 3 shows pan 4 having a center support 6 and two non-linear supports 8 each having multiple damper inserts 10 associated with their top surfaces in non-stacked array, center support 6 and non-linear supports 8 extending substantially across the length of the pan, perimeter grommets 12 integrated into the walls of pan 4, angled corners 30, a stress-transferring member 36 connected between the lower portions of center support 6 and each non-linear support 8, and a combined float switch 16 and drain line connection 18 assembly (shown in FIG. 5 by the number 20) connected to the right side of pan 4 where a drain opening 22 (see FIG. 4) through the wall of pan 4 is located. Although the float switch 16 shown in FIG. 3 with its upwardly-directed electrical wiring 34 has a more rectangular configuration than the cylindrical representation of the float switch housing 16 shown in FIG. 5, both are equally contemplated for use with the present invention pan 4, in addition to any other configuration of float switch 16 and drain line connection 18 assembly 20 that can fulfill the same function and provide self-leveling of float switch 16 when pan 4 is leveled. FIG. 3 further shows the widened convex lower configuration 28 extending outwardly from both sides of center support 6 that also integrated into pan 4 to enhance its strength.

In contrast, FIG. 4 is a top view of the most preferred embodiment 2 of the present invention pan 4 having a center support 6 and two non-linear supports 8, with non-linear supports 8 positioned remotely from one another on opposite sides of center support 6, and no damper inserts 10 associated with the recesses 42 shown on the top surfaces of center support 6 or non-linear supports 8. FIG. 4 further shows center support 6 and non-linear supports 8 extending substantially across the length of pan 4, perimeter grommets 12 integrated into all four walls of pan 4, angled corners 30 between the walls of pan 4, horizontally-extending uppercuts 24 substantially across the bottom interior surface of pan 4 between support 6 and 8 as well as between supports 8 and grommets 12, a single stress-transferring member 36 connected between the center support 6 and each non-linear support 8 in non-aligned locations that do not promote fluid accumulation, a float switch quick-mounting shelf area 52 with a drain opening 22 through it on one side of pan 4, and two struts 38 (or a 2"×4" piece of wood or other under-pan support can also be used) each aligned with undercuts 14 extending laterally across the width of pan 4 between opposed grommets 12. Each strut 38 is shown partially in broken lines and with a hole through each of its exposed ends extending beyond pan 4 that is used for connecting a cable (not shown) to suspend pan 4 from an elevated position. Although the two struts 38*a* and 38*b* shown in FIG. 4 are each aligned with the third pair of opposed grommets 12 counted inward from the ends of pan 4, alignment of struts 38 (a 2"×4" piece of wood or other sturdy under-pan support can also be used) with the fourth pair of opposed grommets 12 on the longer sides of pan 4, the use of more than two struts 38 with pan 4, or the use of struts 38 (or a 2"×4" piece of wood or other under-pan support) with any selection of undercuts 14 that provide balanced suspension of pan 4 in an elevated position is considered to be within the scope of the present invention. Although not limited thereto, undercuts 14 typically are not deep and have a depth dimension of approximately one-eighth of an inch. Further, the undercuts 14 shown in FIGS. 1 and 4, in alternating combination with the uppercuts 24, provide a corrugated pattern that in combination with their perpendicular intersection with supports 6 and 8 adds strength to the bottom of pan 4. FIG. 4 also shows non-linear supports 8 each being at a similar spaced-apart distance from center support 6 and only connected to it via the one previously mentioned stress-transferring member 36. FIG. 4 further shows center support 6 having a length dimension greater than that of non-linear support 8, non-linear supports 8 having a more steeply inclined taper on each of its ends than center support 6, non-linear supports 8 each having a substantially uniform width dimension throughout its curved length, supports 8 each having a non-linear longitudinal axis in addition to a non-linear perimeter configuration, and center support 6 having a substantially linear longitudinal axis but a non-linear perimeter configuration that is centrally narrowed at its top with a lower part 28 having a widened convex configuration that extends out from both sides of center support 6. The structural configuration of center support 6 and non-linear supports 8, including the non-linear perimeters thereof, the differences in end tapering, the widened lower part 28 of center support 6, and the connection of one stress transferring member 36 between center support 6 and each non-linear support 8, all strengthen pan 4 by minimizing the stress points in pan 4 that would otherwise lead to cracking and pan failure during installation and long term use, as is commonly experienced in many prior art pans. Other strengthening features of pan 4 that minimize cracking and pan failure include integrated grommets 12 along each interior side of pan 4, angled corners (shown by the number 30 in FIGS. 2-4), and uppercuts 24 (best shown in FIG. 4). As illustrated in FIG. 4, it is contemplated for adjacent grommets 12 to have differing widths and interior-projecting edges of differing length, to minimize the formation of a stress line in pan 4 adjacent to grommets 12 that could otherwise lead to cracking and pan 4 failure.

FIG. 5 shows one preferred embodiment of a combined float switch 16 and drain line connection 18 assembly 20 that can be connected to the quick-mounting shelf area 52 (best shown in FIG. 4) on the wall of pan 4. Whether the housing of float switch 16 has a substantially rectangular configuration as shown in FIG. 3, the rounded configuration shown in FIG. 5, or other configuration (not shown) is not critical as long as the float switch 16 used in fixed association with drain line connection 18 has reliable and reproducible deployment when needed for emergency shut off of the fluid-producing unit associated with pan 4. Further, the configuration of drain line connection 18 is not critical, as long as it is complementary to that of quick-mounting shelf area 52 whereby when drain line connection 18 is connected to quick-mounting shelf area 52, float switch 16 is instantly placed in a level orientation relative to pan 4. Thus an installer (not shown) of pan 4 simply has to level pan 4 for balanced support of a fluid-producing unit, and does not also have to spend additional time leveling float switch 16 relative to pan 4 so that it is able to properly and repeatedly deploy for emergency shut-off of the fluid-producing unit associated with pan 4. After the drain line connection 18 portion of assembly 20 is aligned with quick-mounting shelf area 52, with float switch 16 being placed adjacent to protective array 26 of vertically-stacked and horizontally-extending arcuate ribs and the tailpiece 61 of drain line connection 18 inserted through the opening 22 in quick-mounting shelf area 52, the tightening of nut 58 from the outside of pan 4 is all that is needed to secure assembly 20 to pan 4 and place float switch 16 in level orientation relative to pan 4. Depending upon the application of pan 4, a plug 60 may be used to block fluid discharge from tailpiece 62, or tailpiece 62 can be connected to a drain pipe (not shown) that is configured to transport excess fluid away from pan 4.

Figure 6:
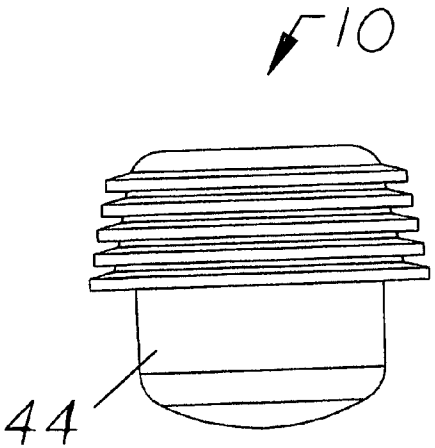
FIG. 6 is a side view of a first style of damper insert usable with the most preferred embodiment of the present invention and having a domed cap configuration.
Figure 9:
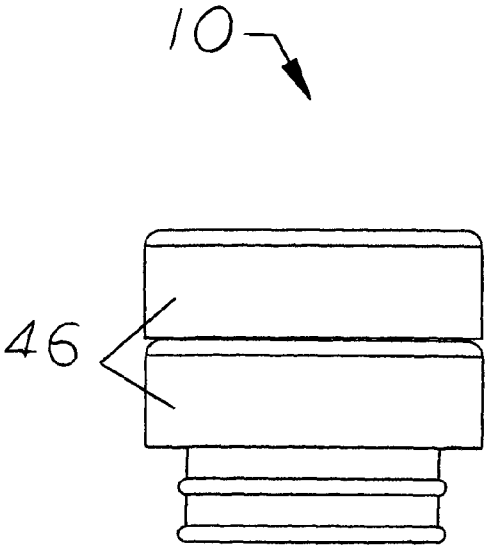
FIG. 9 is a side view of two of the ring style damper inserts in stacked array.
Figure 7:
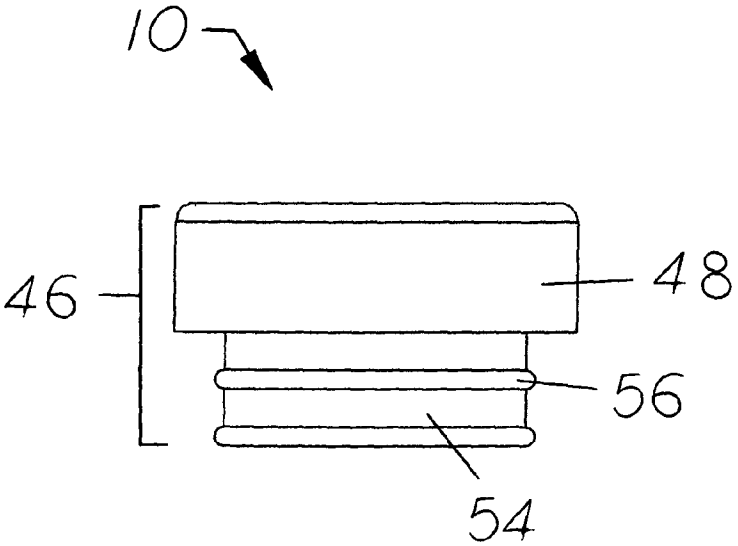
FIG. 7 is a side view of a second style of damper insert usable with the most preferred embodiment of the present invention and having a ring configuration that includes an annular shoulder, a central bore, and a smaller diameter lower end with at least one external rib encircling it.
Figure 8:
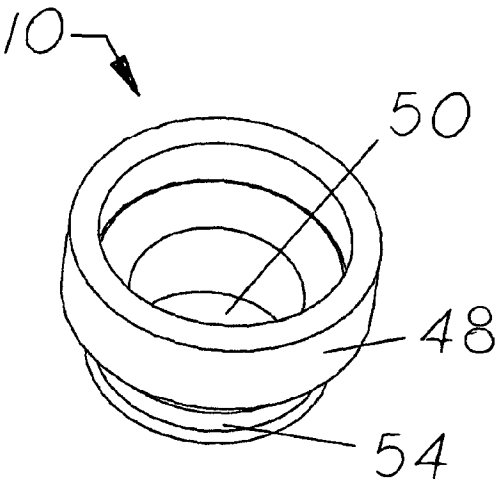
FIG. 8 is a perspective view of the ring style of damper insert with an annular shoulder, a smaller diameter lower end, and a central bore.

The present invention is not limited to one configuration of damper insert 10 associated with the top ends of supports 6 and 8. FIGS. 6-9 show two embodiments of damper insert 10 preferably used in the present invention, a domed cap style 44 and a ring style 46 with a central bore 50. However, other embodiments of damper insert 10 may also be used, particularly when stacking is desired for fluid-producing unit elevation, such as but not limited to a ring style 46 damper insert 10 with a slightly tapered lower end 54 and no ribs. FIGS. 1-3 each show supports 6 and 8 each having several damper inserts 10 associated with its top surface, while FIG. 4 shows the recesses 42 in the top surface s of supports 6 and 8 each configured for receipt of at least one damper insert 10. FIG. 6 shows a damper insert 10 having the style of a domed cap 44, while FIGS. 7-9 shows a ring style 46 damper insert with a large diameter shoulder 48, a reduced diameter lower portion 54, a rib 56, and a central bore 50. Using two or more ring style 46 damper inserts in stacked array, is an easy way to raise a fluid-producing unit (not shown) to optimal operating height, if needed. It is contemplated for damper inserts 10 to be made from rubber, plastic, or other high-friction material, although not limited thereto, so the damper inserts 10 can fulfill their primary function of retaining the fluid-producing unit associated with pan 4 in its originally installed position to maintain pan 4 in a balanced condition that prevents its failure or collapse. The materials used for damper inserts 10 should also be configured for vibration reduction, and for enhancing heat dissipation around the fluid producing unit in association with pan 4.

The invention claimed is:

1. A pan used in fluid collection and overflow prevention applications while supporting a fluid-producing unit, said pan comprising:

a bottom surface and a perimeter wall depending upwardly from said bottom surface, said bottom surface having three spaced-apart, side-by-side, and longitudinally-extending support members upwardly depending therefrom which are collectively configured and positioned for bearing a fluid-producing unit, said longitudinally-extending support members each having opposed ends and extending substantially across said pan while at the same time allowing fluid collecting upon said bottom surface to flow around said opposed ends, said side-by-side positioning of longitudinally-extending support members further providing a center support member which separates the two remaining ones of said support members from one another, said remaining support members each having a non-linear perimeter configuration and a non-linear longitudinally-extending axis, with said center support member having a greater length dimension than each of said remaining support members, said center support member also having a non-linear perimeter configuration, said bottom surface also having a different stress-transferring member connected between said center support member and each of said remaining support members, and said bottom surface also having a plurality of shallow uppercuts spaced apart from one another with each said uppercut configured for trapping and isolating fluid from that collected in other parts of said pan, said uppercuts also positioned substantially across said bottom surface to provide balanced weight distribution of fluid accumulation in said pan, said upper cuts further configured and positioned to promote prompt evaporation of any fluid accumulating in said pan.

2. The pan of claim 1 wherein said support members each have a top surface with a plurality of recesses therein and further comprising a plurality of damper inserts each configured for secure engagement of one of said recesses so that said damper inserts are associated with said recesses and a fluid-producing unit is lowered onto said supports, said damper inserts become positioned between the unit and said supports.

3. The pan of claim 2 wherein said damper inserts are made from materials selected from a group consisting of high-friction materials and resilient materials.

4. The pan of claim 2 wherein said damper inserts are made from materials selected from a group consisting of materials capable of reducing vibration, materials capable of reducing slippage of one object relative to another, and materials capable of enhancing heat dissipation.

5. The pan of claim 2 wherein said damper inserts are positioned in multiple stacked array during use.

6. The pan of claim 2 wherein said damper inserts are selected from a group consisting of inserts having a domed cap configuration, and inserts having a ring configuration having a central bore therethrough.

7. The pan of claim 1 wherein said bottom surface of said pan has a plurality of laterally-extending undercuts configured for engaging under-pan supports and reducing weight transfer.

8. The pan of claim 7 wherein said perimeter wall has integrated grommets in opposite positions from one another, and further wherein said undercuts are aligned with and extend between said oppositely-positioned grommets.

9. The pan of claim 7 wherein said undercuts and said uppercuts are in alternating array and create a strength-enhancing corrugated pattern in said bottom surface.

10. The pan of claim 1 wherein said pan is made from materials selected from a group consisting of polycarbonate, polycarbonate alloys, polycarbonate blends, materials impervious to corrosion, impact resistant materials, UV-resistant materials, and materials substantially unaffected by temperature extremes.

11. The pan of claim 1 further comprising a strength-enhancing upwardly-depending perimeter lip.

12. The pan of claim 8 wherein said perimeter wall further comprises an arcuate recessed area adjacent to a shelf area, and said arcuate recessed area is made from multiple vertically-stacked and horizontally-extending ribs that are collectively configured for protecting a float switch housing.

13. The pan of claim 1 wherein said perimeter wall has at least one strength-enhancing and stress line reducing feature selected from a group consisting of grommets integrated with said wall, grommets integrated with said wall that are situated wherein adjacent ones thereof have interior-projecting edges with differing depth dimensions, angled corners, a quick-mounting shelf area with a drain opening therethrough, and a recessed area configured for protecting a float switch housing.

14. The pan of claim 1 wherein said center support has a mid-section with a narrow upper configuration.

15. The pan of claim 1 wherein said center support has a mid-section with a widened convex lower configuration.

16. The pan of claim 1 wherein said center support has a mid-section with a narrow upper configuration and a widened convex lower configuration.

17. The pan of claim 1 further comprising a nesting configuration.

18. The pan of claim 15 wherein said stress-reducing members connected between said center support member each of said remaining support members are connected to said widened convex lower configuration of said center support member.

19. The pan of claim 7 further comprising under-pan supports, and wherein said under-pan supports are configured to provide suspended support of a fluid-producing unit without sagging and pan failure.

20. The pan of claim 19 wherein said under-pan supports are selected from a group consisting of struts and lumber.

* * * * *